US005191311A

United States Patent [19]

Webb et al.

[11] Patent Number: 5,191,311

[45] Date of Patent: Mar. 2, 1993

[54] SWITCH FOR USE AS A VERTICALLY MOUNTED CUT OUT OR IN-LINE SWITCH

[75] Inventors: Thomas H. Webb, Stouffville; Anthony Cocco, Scarborough, both of Canada

[73] Assignee: Firon Metal Industries Ltd., Scarborough, Canada

[21] Appl. No.: 900,373

[22] Filed: Jun. 18, 1992

[51] Int. Cl.[5] ..... H01H 71/10; H01H 71/20

[52] U.S. Cl. ..... 337/168; 337/172; 337/181

[58] Field of Search ..... 337/168, 169, 170, 171, 337/172, 173, 174, 175, 176, 177, 178, 179, 180, 181

[56] References Cited

U.S. PATENT DOCUMENTS 4,326,184 4/1982 Murdock ..... 337/168

4,414,527 11/1983 Biller ..... 337/180

OTHER PUBLICATIONS

A Sheet entitled Copper Inline Fused Switch.

A Sheet entitled S&C Open Cutouts Type SX from S&C Electric Company, dated Aug. 3, 1981.

*Primary Examiner*—Harold Broome

*Attorney, Agent, or Firm*—Bereskin & Parr

[57] ABSTRACT

A switch, for an electrical transmission line, can be used as a vertically mounted cut out or as an in-line switch. The switch has an insulator, mounting bars at either end, and a first and second brackets extending from the mounting bars. Brackets are configured to receive a fuse element, which can be of known construction. A first bracket includes a pair of bracket elements that defines slots for receiving pivot lugs of the fuse element. To enable the switch to be used either vertically as a cut out or horizontally as an in-line switch, the bracket elements are moveably, preferably rotatably, mounted to the first bracket. The bracket elements can then be located so that the slot is always at least partially directed upwardly. Then, for either use, the fuse element will always be retained by its pivot lugs in the slot. To enable the switch to be mounted as an in-line switch, the insulator can be provided with a relatively narrow central portion to its body and a removable clamp. The clamp would be used for such vertical mounting, and would be removed for use as an in-line switch.

12 Claims, 3 Drawing Sheets

SWITCH FOR USE AS A VERTICALLY MOUNTED CUT OUT OR IN-LINE SWITCH

FIELD OF THE INVENTION

This invention relates to vertical cut outs and fused in-line switches, for use in high voltage electrical distribution or transmission systems.

BACKGROUND OF THE INVENTION

In main transmission systems and also primary distribution of transmission networks, it is common to provide a variety of switches or cut outs that are operated by a lineman. Commonly, these include a vertical cut out, which is mounted on a pole supporting the transmission line, and an in-line switch which is located horizontally in the transmission line itself. The in-line switch is intended to interrupt the flow of current in the transmission line, whilst the vertical cut out can be used to interrupt a connection to the transmission line, and may be connected to a transformer or another portion of the distribution network.

Both types of switches or cut outs include a combined switch and fuse element, which is pivotally mounted at one end in a bracket. At its other end, it has a rounded cap that can be engaged in a recess of a contact plate, which is under spring pressure. For the sake of uniformity and ease of replacement, electrical utility companies usually require that any switch or cut out design be configured to accept a standard fuse element, which also serves a part of a switch. Then, if a fuse element needs to be replaced, a fuse element from any source, made in accordance with the standard specifications, may be inserted, irrespective of the original manufacturer of the switch or cut out.

Usually, in-line switches and vertical cut outs are treated as distinct, separate components for a variety of reasons, even though they may be required to accept a common fuse element.

Firstly, a vertical cut out has a requirement that it must be mechanically mounted to a vertical pole or support. To this end, it has an insulator that is usually formed from porcelain and provided with a bracket glued centrally to the porcelain body. It is then mounted by this bracket to the pole, etc.

As the cut out is supported by the pole, its weight is not too critical. For this reason, porcelain is usually used since it is cheaper, although it is relatively heavy.

At either end of the porcelain body, connection bars are secured by clamps, to provide the electrical input and output connections.

Brackets are also secured to the connection bars. A first bracket is provided with a pair of side members bearing bracket elements which define U-shaped slots. A fuse element then has pivot lugs that engage these slots for pivotal movement. A second bracket has a spring-loaded connection plate which is urged against the end cap of the fuse.

As detailed below, if the fuse blows, the end cap is released from the connection plate, and the fuse can then freely pivot about its pivot lugs in the bracket elements of the first bracket.

For a cut out, to ensure that the fuse element does not become detached, the bracket elements have the U-shaped slots directed upwardly, and slightly outwardly from the cut out. This ensures that the fuse element is retained if it should blow or fail, while at the same time, enabling a lineman to readily replace the fuse element with a new one.

Now, the requirements for an in-line switch are somewhat different. Here, the switch mechanically is part of the transmission line, strung between supporting towers. Accordingly, its weight is important, and it should be kept as light as possible. It must also be capable of withstanding the tension in the transmission line. For this reason, in-line switches are now often made from EPDM or a silicone polymer insulator. These usually have a fibreglass core to which the mechanical connection bars are secured by clamping at either end. This provides for the necessary mechanical strength, capable of withstanding the tension in the line. Further, unlike the insulator for a cut out, there is no necessity to provide a bracket in the middle, and hence, the insulator for an in-line switch is usually formed as a series of uniformly spaced disc elements, to provide the necessary insulating characteristics.

As an in-line switch is mounted generally horizontally, the bracket elements for holding the pivot lugs of the fuse should be oriented facing upwardly and towards the insulator itself. Then, when the fuse blows or fails, it will swing down and remain pivoted in those bracket elements. Again, it can then be readily exchanged by a lineman for a new fuse element.

In conventional cut outs and in-line switches, the bracket elements are integral with the respective brackets. In view of the different angular orientations of the bracket elements required for the two types of switches, as detailed above, it is then required to form, usually by casting, different brackets for each type of switch or cut out.

Accordingly, for all the foregoing reasons, at the present time it is common to manufacture in-line switches and cut outs as entirely separate components. Bearing in mind that such components can come in a variety of sizes, this places a burden on electrical utility companies to maintain substantial stocks of two different types of devices.

SUMMARY OF THE PRESENT INVENTION

Applicants have therefore realized that it is desirable to provide a common switch body, which will accept a fuse element of standard design, which switch body can be configured for use either as an in-line switch, or as a vertical cut out.

Further, it is preferable that the switch includes a mechanism that enables it to be quickly and simply adjusted for use either in a vertical orientation as a cut out, or in a horizontal orientation as an in-line switch.

In accordance with the present invention, there is provided a switch, for an electrical transmission line, the switch comprising:

first and second connection bars;

an insulator mechanically connected between the first and second connection bars;

first and second brackets connected to the first and second connection bars respectively, for engaging and retaining a fuse element, which includes pivot lugs at a first end thereof, and a second free end, the second bracket being adapted to engage and retain the second end of the fuse element; and bracket elements adjustably mounted on the first bracket and defining slots for pivotally receiving the pivot lugs of the fuse element, the bracket elements being adjustable to orient the slot at least partially upwardly, when the switch is in either one of a horizontal position and a vertical position, whereby, if the second end of the fuse element is released, the pivot lugs will be retained by the slots.

Preferably, the first bracket has a pair of side members, with arcuate slots for receiving bolts, the arcuate slots having a common centre. The bracket elements are then mounted by means of bolts in those arcuate slots. The bracket elements are adjusted by loosening the bolts and rotating the bracket elements, and resecuring the bolts. The arcuate slots should be sufficient to enable movement through approximately 60° although this can be varied as desired.

The insulator preferably has a plain central section, without any annular, disc portions. To this central portion, a bracket can be mounted, when it is desired to use the switch as a vertically mounted cut out.

BRIEF DESCRIPTION OF THE DRAWING FIGURES

For a better understanding of the present invention, and to show more clearly how it may be carried in effect, reference will now be made, by way of example, to the accompanying drawings, in which.

DESCRIPTION OF THE PREFERRED EMBODIMENT

Figure 1:
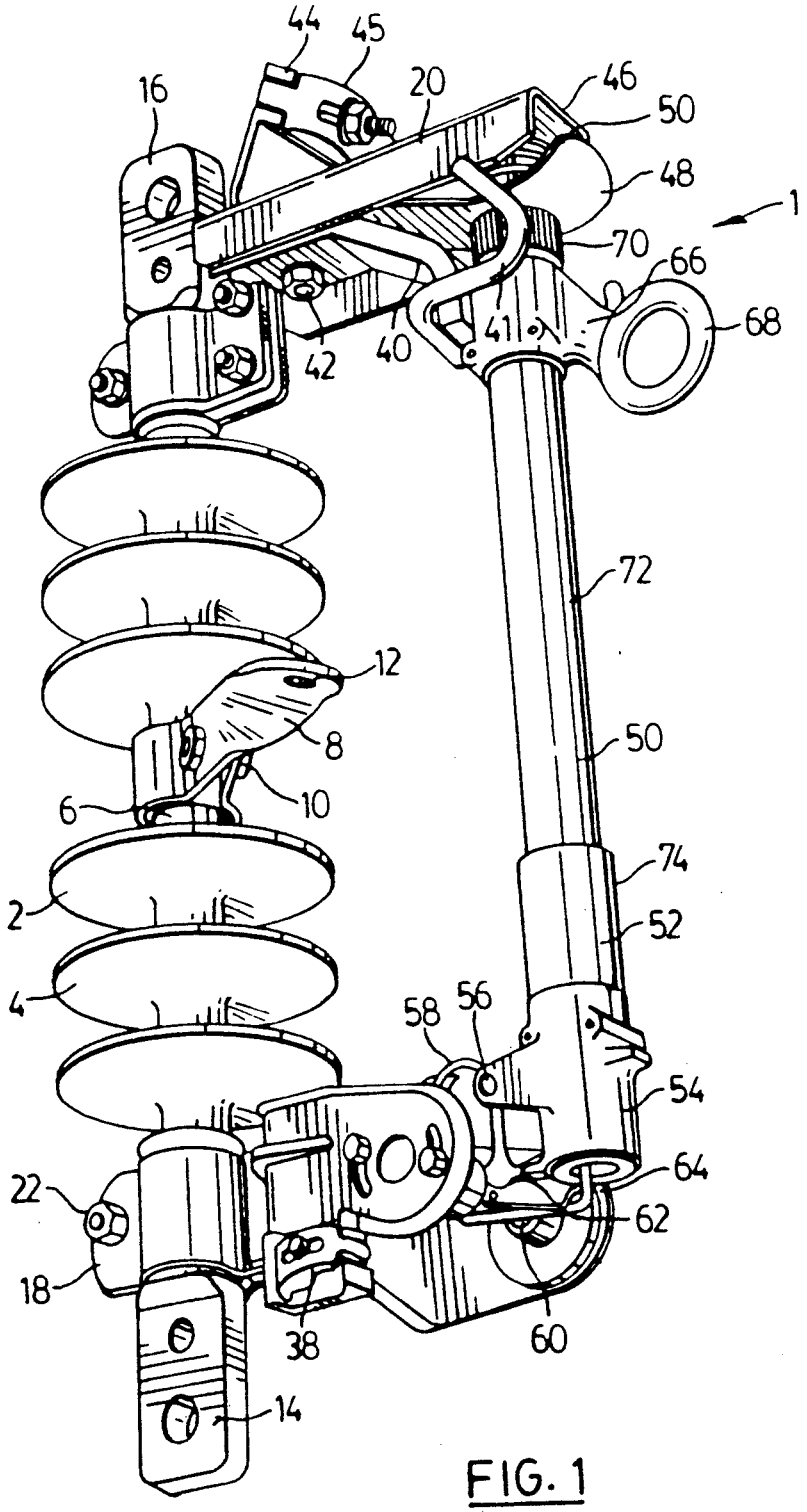
FIG. 1 is a perspective view of a switch in accordance with the present invention.

Referring first to FIG. 1, the switch as a whole is denoted by the reference 1. The switch 1 includes an insulator 2 which here would be formed from EPDM or a silicone polymer, with a fibreglass core. In known manner, the insulator 2 includes a series of annular discs 4 designed to enhance the insulator properties of the insulator 2 and prevent unwanted discharge.

For the center of the insulator 2, there is a central portion 6 which is formed as a plain cylindrical portion. This enables a bracket 8 to be secured. The bracket 8 could be a simple strip of sheet steel secured by nut and bolt 10, as shown. The bracket 8 could be formed with an opening 12, to enable it to be mounted to a pole or other support structure, for use as a vertically-mounted cut out. Preferably, the bracket 8 is covered in some insulative material.

For use as an in-line switch, the bracket 8 would be removed.

At either end of the insulator 2, in known manner, there are a first mounting bar 14 and a second mounting bar 16. These mounting bars 14, 16 are secured to the ends of the insulator 2 and are provided with appropriate openings for securing in a line. In use, as an in-line switch, the insulator and mounting bars form the mechanical connection on the line, and must be capable of withstanding the tension in the line, which can be considerable.

For forming the electrical connection, respective first and second brackets 18 and 20 are secured to the first and second mounting bars 14, 16.

Figure 4:
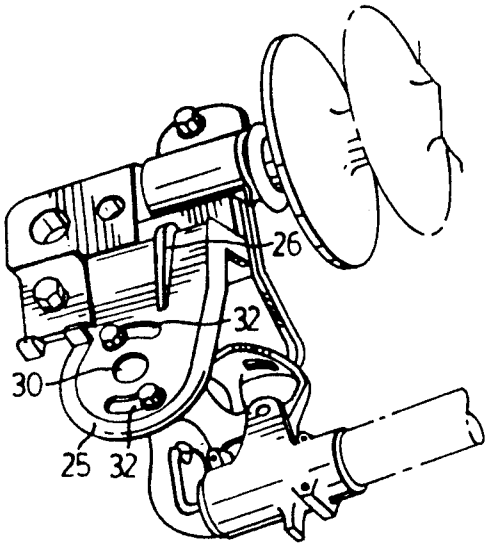

The first bracket 18 has two generally complementary clamping members 22, which are formed from sheet steel and are clamped by appropriate bolts around the collar of the first mounting bar 14. As shown in FIG. 4, a pair of side members 24 are clamped to the outsides of the clamping members 22, and there would usually be some spacing element between the clamping members 22 at this point.

The side members 24 are cast from bronze and are provided with appropriate reinforcing ribs, such as a rib 25 around the edge thereof, an outer rib 26, and inner edge ribs 27.

As shown, the free end of each side member is formed with an aperture 30, and a pair of arcuate openings 32, which are centered on the same axis as the aperture 30.

For the other end, the second bracket 20 has similar clamping members 22. On one side, these clamp a cast arcing control member 40. In turn, nut and bolt 42 clamp to the arcing control 40, a connection bracket 44, a channel member 46 and a contact plate 48. A spring 50 is provided to spring-load the contact plate 48 against an end of a fuse element in known manner, as detailed below.

Also, in known manner, the connection bracket 44 is provided with a clamp 45, secured by a nut and bolt, for clamping a free end of a cable, to make an electrical connection to the second bracket 20.

In known manner, the arcing control member 40 has side members 41, shaped to control arcing when a fuse element is disengaged from the contact plate 48.

Inside each of the first side members 24, there is a bracket element 33, the bracket elements 33 being generally symmetrical. Each bracket element 33 has a cylindrical portion 34 that extends through the respective aperture 30. Bolts 35 extend through the arcuate openings 32 and engage threaded bores of the bracket elements 33. Each bracket element 33 is formed with an elongate slot having generally U-shaped sidewalls, and indicated at 36. The bottom of each slot 36 forms a pivot bearing, while the end of each slot is flared open, to facilitate insertion of a fuse element.

Figure 3:
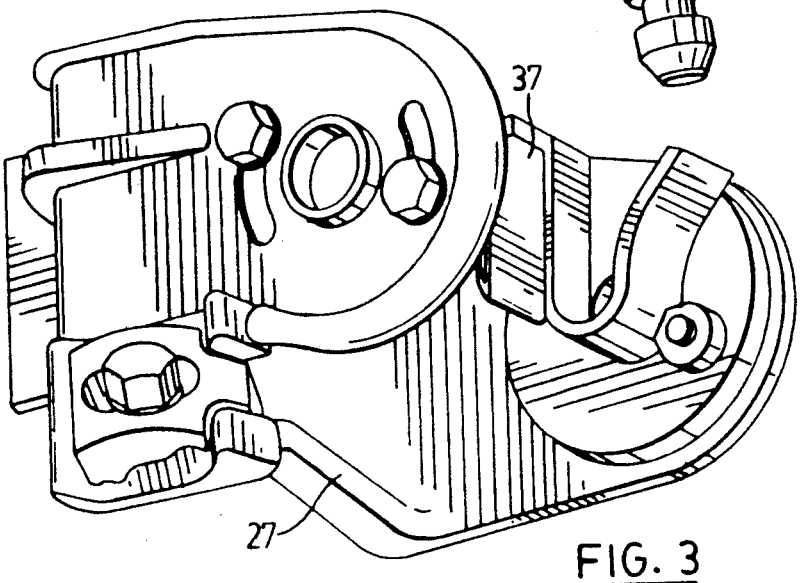
FIG. 3 is a perspective view, on a larger scale, of a first bracket of the switch, showing bracket elements in a position for use as a vertical cut out.

As best shown in FIG. 3, each bracket element has mounted to it a bronze spring 37 for providing an electrical connection to the fuse element, as detailed below.

A fuse element for use in the switch 1 is indicated generally at 50. It will be appreciated that the fuse element 50 is made in accordance with standard specifications. As mentioned above, electrical utility companies commonly require such fuse elements 50 to be made to standard specifications concerning external dimensions and mechanical and electrical characteristics.

Thus, in known manner, the fuse element 50 has a main body 52. At a first end, it has a first end element 54, secured to the main body 52 and providing arms with pivot holes 56. A rivet pivotally secures a link member 58 in the pivot holes 56. The link member 58 includes a pair of pivot lugs 60 in known manner. At 62 the link member and the first end element 54 have a pair of abutting surfaces. A cable 64 forming part of the fuse mechanism is maintained in tension, to maintain the abutting surfaces 62 in contact and the relative position between the link member 58 and the main body 52. In use, if the fuse blows or fails, then the cable 64 is released, permitting pivotal movement of the link member and separation of the abutting surfaces 62.

At the other or second end of the fuse element 50, there is a second end element 66, provided with a ring 68, which in use can be engaged by a hook of a rod held by a lineman. A screw cap 70 closes off the end of the main body 52, and permits access to the fuse mechanism within, in known manner. The screw cap 70 is provided with a generally rounded end, complementary to a dish recess formed in the compact plate 48.

Figure 2:
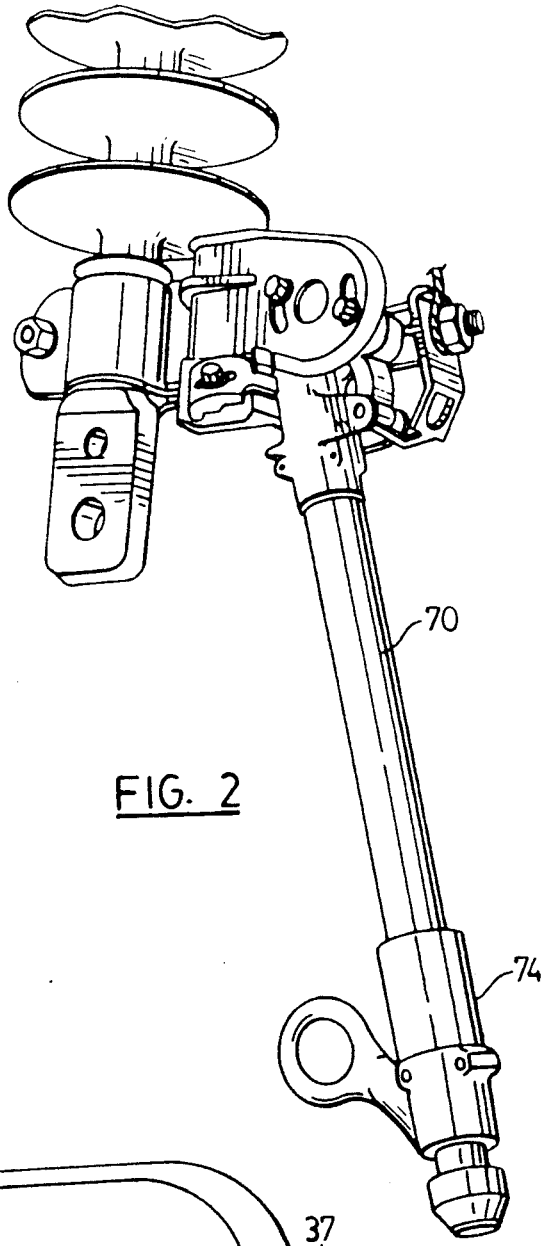
FIG. 2 is a perspective view of part of the switch of FIG. 1, showing a fuse element in an open position.

In use, the bracket elements 33 can be oriented in two different positions. FIGS. 1, 2 and 3 show the bracket elements oriented for use vertically as a cut out. Here, the mounting bracket 8 would be moved around the insulator 2, to be directed away from the fuse element 50, and secured to a suitable mounting point. The connecting bars 14, 16 would be redundant in this configuration. The clamps 38, 45 would be used to secure appropriate electrical connections.

As best shown in FIG. 3, the bracket elements 33 are then oriented facing generally upwardly. In this configuration, the pivot lugs 60 of the link of a fuse element 50 can be engaged with the slots 36. The fuse element can then be swung upwards and engaged with the contact plate 48 in known manner. This then completes the electrical circuit.

To open the circuit, the second or upper end of the fuse element 50 can be disengaged by pulling on the ring 68 in known manner. Alternatively, if the fuse fails, then the cable 64 is released. This permits the link member 58 to pivot relative to the main fuse body 52. Effectively, the fuse body 50 can drop generally vertically downwardly, until the end cap 70 is disengaged from the contact plate 48. Note that the spring 50 encourages its downward movement. The main body 52 can then swing outwardly and downwardly to the position shown in FIG. 2.

It can be noted that the orientation of the slots 36 is such as to ensure that, even when the fuse blows, it is retained securely in position. A lineman can then disengage the fuse element 50 from the slots 36 in known manner, insert a fresh fuse, and reengage it with the contact plate 48, to complete the circuit again.

Figure 6:
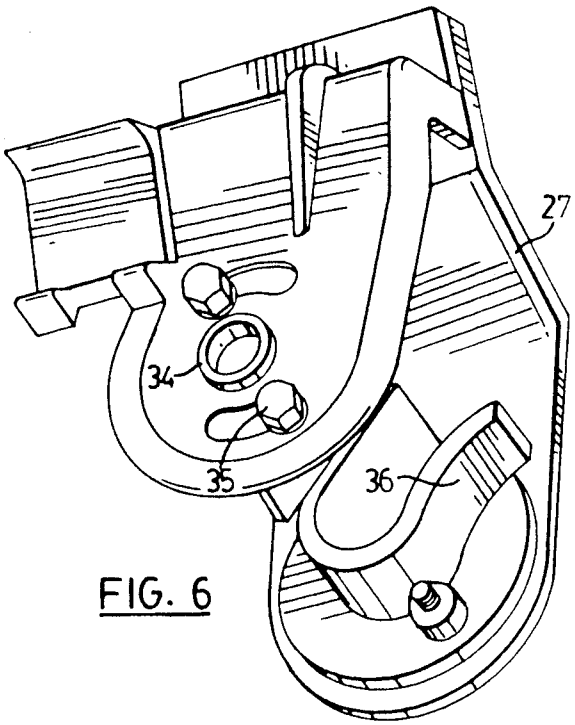
FIG. 6 is a perspective view of the bracket on a larger scale, similar to FIG. 3, showing the bracket elements oriented for use as an in-line switch.
Figure 5:
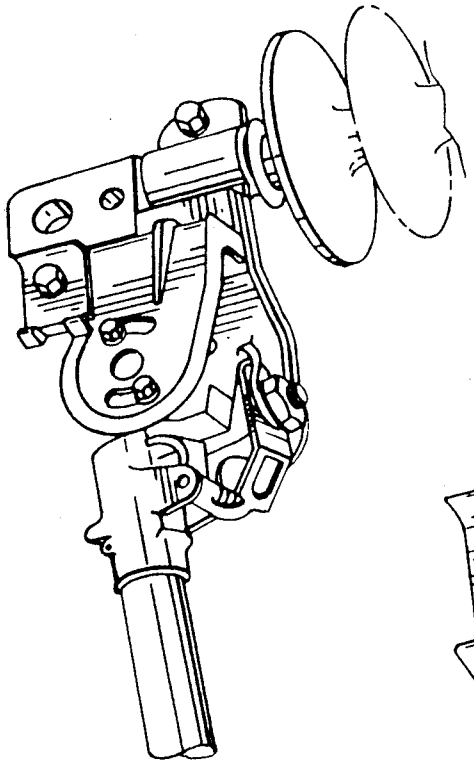
FIGS. 4 and 5 are perspective views showing operation of the fuse.

For use as an in-line switch, the insulator 2 and whole switch 1 would be oriented generally horizontally. In this configuration, the first and second brackets 18, 20 would point downwardly from the insulator 2. Here, to ensure that the fuse element 50 is securely retained, the bracket elements 33 would be moved to the position shown in FIG. 6. This is readily achieved, by loosening the bolts 35 and moving the bracket elements 33 as desired, before retightening the bolts. The bolts 35 are then at the opposite limit of the arcuate opening 32 as shown in FIGS. 4, 5 and 6.

The slots 36 are then, again, orientated generally upwardly, and in this case, face towards the adjacent end of the insulator 2.

The fuse element 50 would then function in a similar manner. If the fuse blows, or if it is manually disengaged from the contact plate 48, then the main body of the fuse 52 can swing downwardly. Again, since the slots 36 are still facing upwardly, the pivot lugs 60 will be securely retained, and the fuse 50 will hang there, until it is replaced.

For use in the in-line configuration, the mounting bracket 8 will be detached, and the first and second mounting bars 14, 16 connected in the transmission line. Again, the clamps 38, 45 would be used to effect the electrical connections to the first and second brackets 18, 20.

The arcuate openings 32 can have an angular extent of approximately 60°, to permit the bracket element 33 to be moved through approximately 60°.

A further aspect of the present invention is the provision of an indicator to provide a clear indication of a fault condition or a failed fuse. This comprises a first section 70 and a second section 72 of contrasting colours, on the main fuse body 52. A sleeve 74 covers the first section 72. Preferably, the size and colours of the two sections and the sleeve are such as to make them readily visible to a lineman from a distance. This should make it easier for the lineman to identify a failed fuse.

As shown in FIG. 1, the vertical orientation ensures that initially the first section 70 is covered by the sleeve 74. In FIG. 2, when the fuse has dropped down, the sleeve drops down to reveal the first section 70 and cover the second section 72. Thus the second section 72 and the sleeve 74 could be of one colour and the first section of another colour.

For use as an in-line switch, the fuse element 50 should be arranged with the second end at least slightly higher than the first end, to ensure that the sleeve 74 is normally maintained in position.

We claim:

1. A switch, for an electrical transmission line, the switch comprising:

first and second connection bars;

an insulator mechanically connected between the first and second connection bars;

first and second brackets connected to the first and second connection bars respectively, for engaging and retaining a fuse element, which includes pivot lugs at a first end thereof, and a second free end, the second bracket being adapted to engage and retain the second end of the fuse element; and bracket elements adjustably mounted on the first bracket and defining slots for pivotally receiving the pivot lugs of the fuse element, the bracket elements being adjustable to orient the slot at least partially upwardly, when the switch is in either one of a horizontal position and a vertical position, whereby, if the second end of the fuse element is released, the pivot lugs will be retained by the slots.

2. A switch as claimed in claim 1, wherein the bracket elements are rotatably mounted to the first bracket and securing means is provided for securing the bracket elements to the first bracket.

3. A switch as claimed in claim 2, wherein the first bracket includes side members, each of which includes a pair of arcuate slots, and wherein the securing means comprises bolts engaging the bracket elements, for securing each bracket element to a respective side member.

4. A switch as claimed in claim 3, wherein each side member includes a circular aperture, and each bracket element includes a cylindrical portion pivotally engaged in that circular aperture, with the arcuate openings and the circular aperture for each side member having a common axis.

5. A switch as claimed in claim 4, wherein each side member includes a planar internal surface, the planar surfaces of the side members being parallel to one another, and each bracket element has a planar surface abutting the planar internal surface of the respective side member.

6. A switch as claimed in claim 5, wherein each bracket element includes a generally U-shaped wall defining the slot thereof.

7. A switch as claimed in claims 3, 4 or 6, wherein the circumferential extent of the arcuate openings is sufficient to enable each bracket element to be pivotally moved through approximately 60°.

8. A switch as claimed in claims 3, 4 or 6, wherein each side member comprises a cast sidearm including internal and external reinforcing ribs.

9. A switch as claimed in claims 3, 4 or 6, for use with a fuse element including cam contact surfaces integral with the pivot lugs thereof, wherein each bracket element includes a resilient contact spring, which in use, engages the cam contact surfaces of a fuse element to form an electrical connection.

10. A switch as claimed in claims 1, 3, 4 or 6, wherein the insulator includes a plurality of annular disk members and a central portion of relatively narrow diameter located generally equi-distant between the ends thereof, and a removable mounting clamp secured to the central portion, the removable mounting clamp enabling the switch to be secured to a support for use as a vertically mounted cut out, and being removable for use as an in-line switch.

11. A switch as claimed in claims 1, 3, 4 or 6, in combination with a fuse element comprising:

a main body;

a first end element;

a link member pivotally connected to the first end element and including pivot lugs;

abutting surfaces on the first end element and the link member;

a fuse mechanism maintaining the abutting surfaces in contact with one another; and a second end element at the second end of the body;

wherein the pivot lugs are engaged with the slots of the bracket elements and the second end element is engaged with the second bracket, and wherein when the fuse element releases the link member to permit said abutting surfaces to separate, the second end element is released from the second bracket to permit the fuse member to pivot away from the second bracket, while the pivot lugs are retained within the slots of the bracket elements.

12. A combination as claimed in claim 11, wherein the body of the fuse element has first and second sections of contrasting colour, and a sleeve slideably mounted on the body and located covering the first section, wherein the first section is located adjacent the first end of the fuse element, whereby, in use, if the fuse element fails and the second end of the fuse element becomes disengaged from the second bracket, the fuse element hangs downwardly with its second end below the first end thereof, causing the sleeve member to slide down to reveal the first section of the body, to indicate a fault condition.

* * * * *